United States Patent [19]

Persson

[11] Patent Number: 4,606,213

[45] Date of Patent: Aug. 19, 1986

[54] TOOL FOR PRODUCING BENDS IN CURVED SURFACES

[75] Inventor: Bengt G. Persson, Olofström, Sweden

[73] Assignee: AB Volvo, Gothenburg, Sweden

[21] Appl. No.: 636,002

[22] Filed: Jul. 30, 1984

[30] Foreign Application Priority Data

Aug. 5, 1983 [SE] Sweden ..... 8304103

[51] Int. Cl.[4] ..... B21D 11/20

[52] U.S. Cl. ..... 72/300; 72/312; 72/415; 72/465

[58] Field of Search ..... 72/300, 312–314, 72/414, 415, 386, 385, 465, 382, 381

[56] References Cited

U.S. PATENT DOCUMENTS

| | | | |
|---|---|---|---|
| 939,468 | 11/1909 | Boyce | 72/414 |
| 1,354,779 | 10/1920 | Rydbeck | 72/465 |
| 2,332,435 | 10/1943 | Bucklein | 72/313 |
| 2,438,837 | 3/1948 | Archer et al. | 72/465 |
| 4,250,728 | 2/1981 | King | 72/385 |

FOREIGN PATENT DOCUMENTS

| | | | |
|---|---|---|---|
| 1602494 | 12/1970 | Fed. Rep. of Germany | 72/465 |
| 7211 | 5/1963 | Japan | 72/385 |
| 416069 | 11/1980 | Sweden | 72/285 |
| 417288 | 3/1981 | Sweden | 72/300 |
| 422284 | 3/1982 | Sweden | 72/300 |

*Primary Examiner*—Daniel C. Crane

*Attorney, Agent, or Firm*—Young & Thompson

[57] ABSTRACT

A tool for producing bends or steps in curved surfaces has an upper and a lower tool part arranged to work towards one another when in operation. The tool part surfaces conform in shape with the curved surface in which one or more bends are to be formed. The tool part surfaces are made as form tools resiliently mounted and guided in the upper and lower tool parts. The form tools also identify in shape with the original curved surface. The inventive tool is suitably arranged in a press.

4 Claims, 8 Drawing Figures

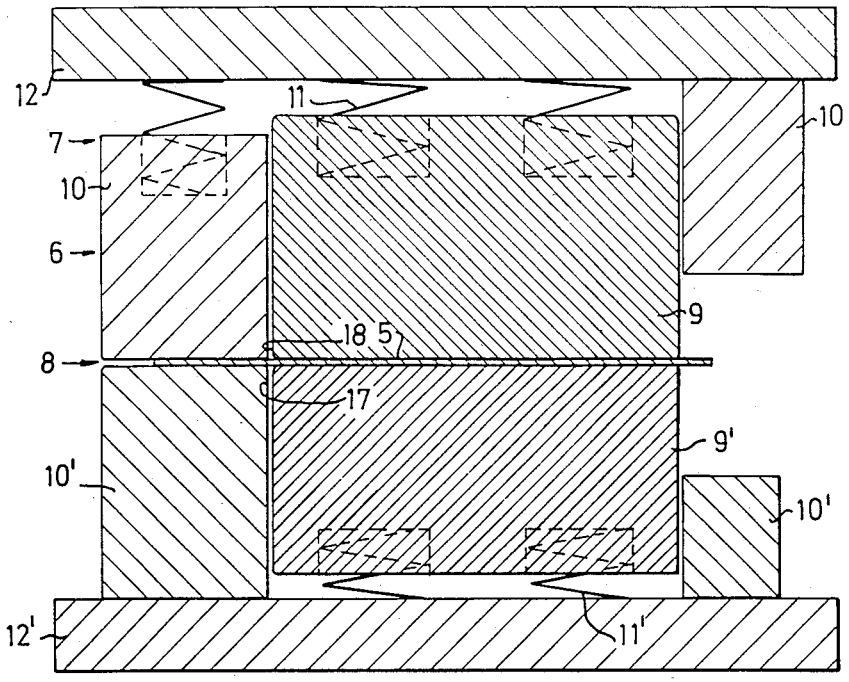
FIG. 2 (PRIOR ART)
FIG. 3 (PRIOR ART)
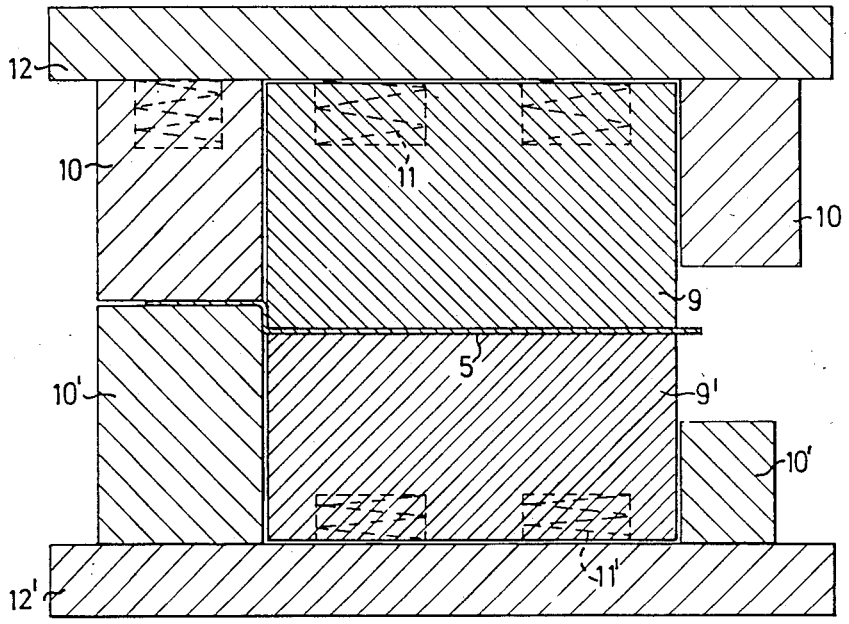

TOOL FOR PRODUCING BENDS IN CURVED SURFACES

The present invention relates to a bending tool for producing bends in curved surfaces in ductile materials, such as plastic and/or metal materials, without straining the material or giving rise to sharp jumps therein. The only mechanical force to which the material is subjected is a bending force, such as to produce a bend of given radius, the radius of said bend being adapted to the thickness of the material, as will be understood.

When wishing to bend or step corrugated sheeting for example, such as to produce a terminal flange along one edge thereof, it is a relatively easy matter to produce a flange when bending the sheeting in the longitudinal direction of the corrugations, whereas bending at right angles to the longitudinal direction of the corrugations will present problems, since the curved surface becomes creased, and cracks as the bend is formed, as do also the surfaces of the flange, that is if it is at all possible to produce a flange. As will be understood, any surface finish present on the sheeting before making the bend, such as paint, anti-rust coatings and other coatings, will disintegrate and become seriously impaired, which constitutes a serious disadvantage and drawback.

One known bending tool for producing bends in curved surfaces comprises one or more upper parts and one or more lower parts mounted in a frame structure provided with guides, such as to enable the upper and lower parts of the bending tool to move relative to one another. These bending-tool parts, which are intended to receive therebetween a pre-shaped blank exhibiting curved surfaces, have located thereon portions which are arranged to form a bend in a curved surface of the sheeting in dependence upon the desired angle of the bend to said curved surface. To this end, the aforesaid portions of the bending-tool parts are designed so as to present the desired angle to said surface and so that those surfaces of the bending-tool parts which are to form the web or flange surface of the bend or bends have a shape which identifies or conforms with the contours of the curved surface in which the bend is to be made, the tool-part surfaces which form the web or flange surface of the bend extending substantially parallel with the direction of movement of said tool parts. One disadvantage with this known bending tool is that when working at a high production rate, the tool-part surfaces which form the bends in the curved surfaces of the workpiece are likely to become coated. This is particularly true in the case when bending coated steel sheets, and non-coated sheets of small thicknesses.

These disadvantages are surprisingly overcome by means of the present invention, according to which the tool-part surfaces of the bending tool which form the web or flange surfaces of the bend(s) comprise form-tools which are resiliently mounted, e.g. by spring means, and guided in the upper and lower parts of the bending tool, and in which the spring means of one form-tool is weaker than the spring means of the other.

In a preferred embodiment of the invention, the spring means of the lower form-tool is weaker than that of the upper form-tool.

In accordance with the invention the lower form-tool is arranged to move against a stop means, such as to cause an additional bend to be formed in the web or flange surface of the bend.

In the embodiments according to the invention, the upper and lower form-tools are preferably displaced laterally in relation to one another, to an extent which is at least equal to a blank thickness.

The invention will now be described in more detail with reference to the accompanying schematic drawings and to a simple exemplary embodiment in which a bend of 90° is formed in a curved surface, of which drawings FIG. 1 is a perspective view of part of a corrugated sheet, illustrating a convex longitudinally extending corrugation;

FIG. 2 is a sectional view of a known bending tool, in an open position;

FIG. 3 illustrates the position of the tool subsequent to having completed a working stroke;

Figure 4:
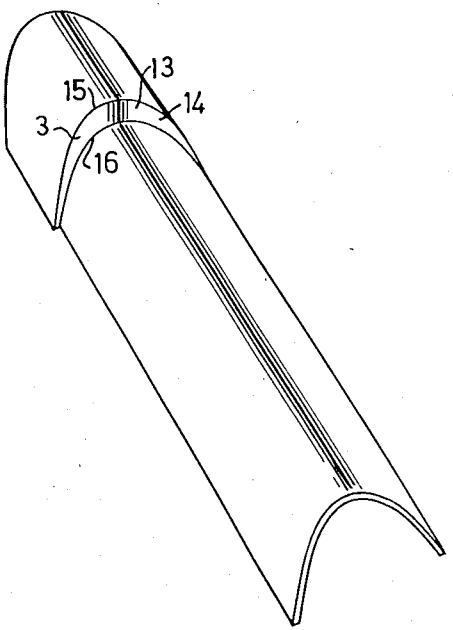
FIG. 4 illustrates the corrugation of FIG. 1, subsequent to having formed a bend in the curved surface of said corrugation.
Figure 1:
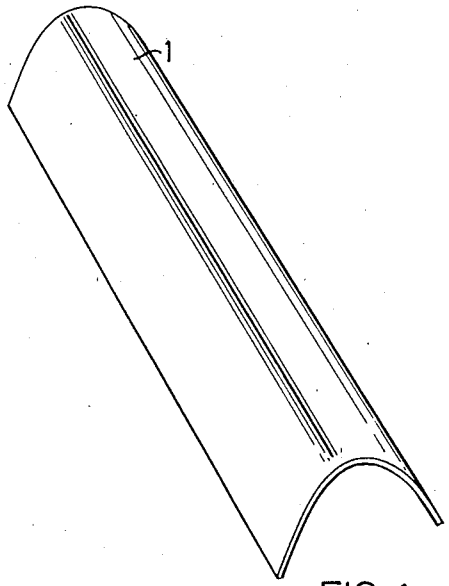

In FIG. 1 there is shown a curved surface 1, a ridge, forming part of a corrugated sheet produced by shaping an initially planar blank. The bend or step 3 illustrated in FIG. 4 is to be formed in said curved surface 1.

The corrugated sheet may be galvanized, painted or plastic-coated.

When the bend or step is to form an angle of 90° with the original curved surface, the bend is formed by placing a curved metal-sheet blank 5 horizontally in a bending tool 6 comprising an upper tool-part 7 and a lower tool-part 8 arranged for relative movement in guide means (not shown), the bending tool suitably being mounted in a press (not shown).

Each of the upper tool-part 7 and the lower tool-part 8 comprises mainly two parts, comprising holding jaws 9,9' and steadying jaws 10,10'. The holding jaws 9,9' are movable in and guided by the steadying jaws 10, 10', and are acted upon by respective springs 11,11'. The references 12,12' identify plates by means of which the tool is attached to a press (not shown).

Figure 5:
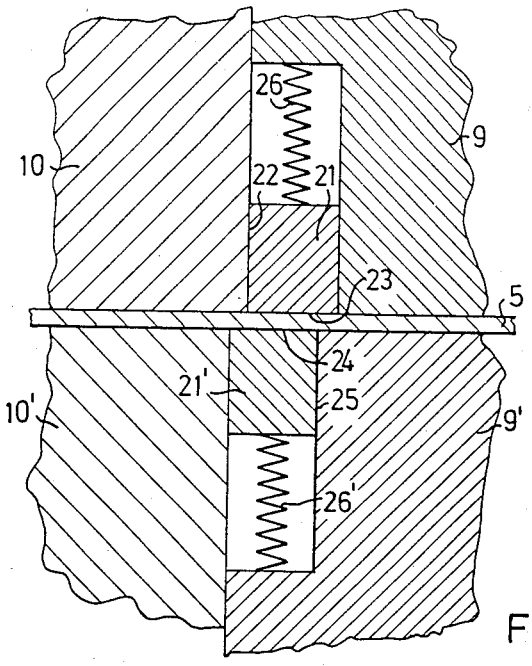
FIG. 5 illustrates in detail the tool-part surfaces designed in accordance with the invention to form said bend, and shows the tool-part surfaces in a starting position corresponding to FIG. 2.
Figure 6:
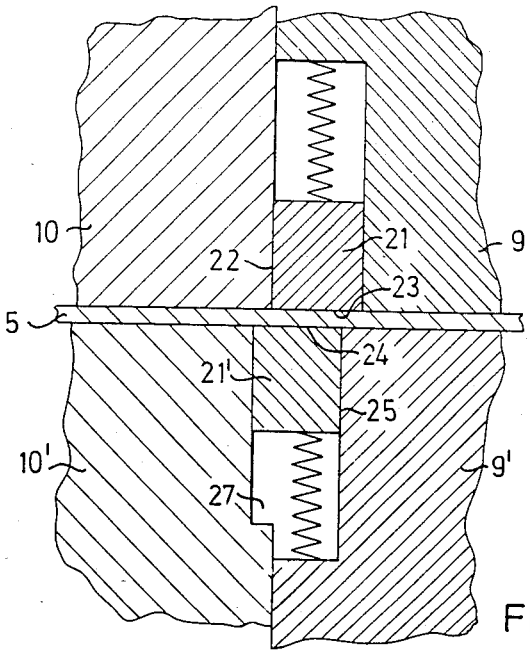

FIGS. 5 and 6 illustrate schematically in more detail the tool areas 17,18 indicated in FIGS. 2 and 3, in respect of two embodiments of the invention.

In accordance with the invention, form-tools 21,21', FIGS. 5 and 6, are spring-mounted and guided in the holding jaws 9,9' as tool-part surfaces effective to form the bend or step in the curved surface 1 of FIG. 1. The form-tools 21 and 21' have working surfaces or effective surfaces 22 and 23, 24 and 25, the shape of which conforms with or has identity with the curved surface 1, FIG. 1. Thus, the working surface 23 of the form-tool 21 has the same shape as the curved surface 1, although with the exception of any deviation required to adapt for the thickness of the blank, suitable radii etc. The working surface 22 of the form-tool 21 may also have the same shape as the curved surface 1, although placed vertically, since in the illustrated embodiment the bend or step is to form an angle of 90° with the original surface. As will be understood, the transition region between the working surfaces is suitably rounded.

By resiliently mounting the form-tools 21 and 21' in the holding jaws 9,9' there is obtained a smooth action when bending the curved surface 1, in addition to preventing the form-tool surfaces from becoming coated or tacky, and greatly improving the appearance of the bend or step, this latter being particularly true in the case of coated metal sheet.

Figure 5A:
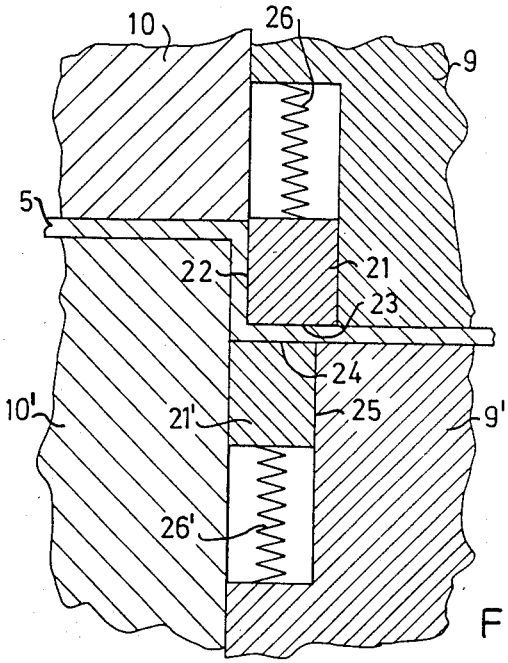
FIG. 5A illustrates the positions of the same tool-part surfaces subsequent to completing a working stroke, corresponding to FIG. 3, and FIGS. 6 and 6A are views corresponding to FIGS. 5 and 5A respectively of a further embodiment of the invention.

FIG. 5 illustrates the bending-tool in its starting position, while FIG. 5A illustrates the tool subsequent to having completed a working stroke, during which a 90°-bend is formed in the blank 5 on the curved surface 1 thereof, FIG. 4.

In the illustrated embodiment, the spring 26 of the form-tool 21 is assumed to be stronger than the spring 26' of the form-tool 21'. As a result hereof, the form-tools will take the positions schematically illustrated in FIG. 5A and the blank 5 will be stepped in the illustrated manner.

Figure 6A:
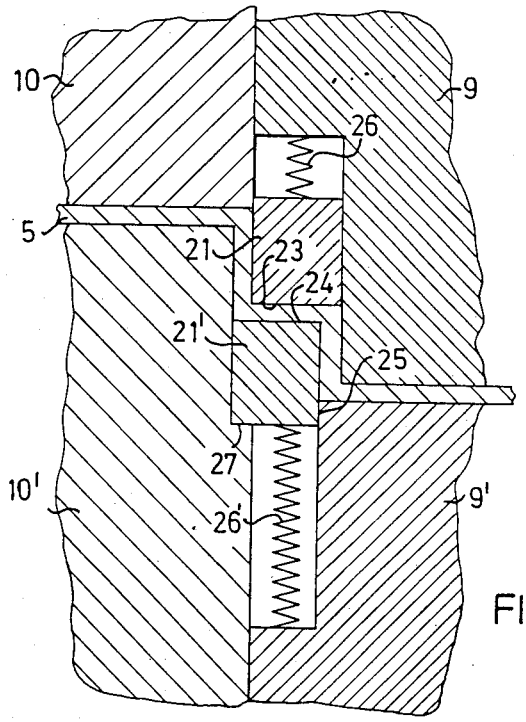

When the form-tool 21 is caused to move against a stop 27 during a working stroke, as shown in FIG. 6, there is formed, if so desired, two sequential 90°-bends, as illustrated in FIG. 6A. In the illustrated embodiment, the stop 27 has the form of a shoulder formed on the lower steadying jaw 10', although it can alternatively be arranged in a suitable manner on any fixed surface.

Although not shown, it is possible to form an angle other than 90° between the web of the bend 13 and the curved surface 1, by providing the form-tool 21, FIG. 5, with an oblique chamfer between the working surfaces of the form-tool 21, despite the fact that the form-tool moves at 90° to the curved surface 1. Thus, it is possible to form in individual parts of the web of the bend, if so desired, areas of different angles to the curved surface 1, by providing the working surface 22 of the form-tool 21 with regions which are chamfered or inclined relative to the working surface 23, such that the surfaces of said regions form in the finished bend 13 mutually different angles to the curved surface 1.

The web or flange surface 14 of the bend can be imagined to have been formed by taking a piece of the blank 5 with its curved surface 1 and inserting said piece, in this case at 90°, through the curved surface 1. Lines 15,16 are then obtained in the curved surface 1, an upper and lower as shown in FIG. 4, when producing a bend or step in said curved surface.

The described embodiment relates to the principle of the invention, and it will be understood that bends can be formed in the manner described with reference to the shown embodiment in a fully corrugated sheet or in a curved surface on some other sheet.

What I claim is:

1. In an apparatus for producing steps in sheet material having at least one corrugation therein with the step extending transverse to the direction of corrugation, comprising a first pair of opposed tools for engaging opposite sides of a said sheet and having sheet-engaging surfaces having the curvature of teh sheet, a second pair of opposed tools disposed adjacent the first pair of tools for engaging opposite sides of a different portion of the sheet and having sheet-engaging surfaces having the curvature of the sheet, said first pair of tools and said second pair of tools being arranged so that sides of said first pair of tools face sides of said second pair of tools, and means for moving the second pair of tools together relative to the first pair of tools in a direction at right angles to the direction of the corrugation thereby to form a said step; the improvement comprising a third pair of opposed tools carried by and movable with the second pair of tools on the same side of the second pair of tools as said first pair of tools for engaging opposite sides of a said sheet so that sides of said third pair of tools face said first tool sides, said third pair of tools having sheet-engaging surfaces having the shape that is to be imparted to the sheet adjacent the formed step, means supporting the third pair of tools on the second pair of tools for movement relative to the second pair of tools, and means acting between the third pair of tools and the second pair of tools yieldably to urge said third pair of tools toward the sheet relative to said second pair of tools.

2. Apparatus as claimed in claim 1, said first pair of tools being arranged as an upper tool urged downwardly by said urging means and a lower tools urged upwardly by said urging means, said upper tool being urged downwardly with a greater force than the force with which said lower tool is urged upwardly.

3. Apparatus as claimed in claim 1, and stop means disposed on one of said first tools to stop the movement of the adjacent said third tool while permitting continued movement of the adjacent said second tool during a step-forming operation thereby to form a second said step subsequent to the formation of a first said step.

4. Apparatus as claimed in claim 1, in which said first and third tools on one side of said sheet are displaced in the direction of the corrugation relative to the first and third tools on the opposite side of the sheet, by a distance at least equal to the thickness of the sheet in which a step is to be formed.

* * * * *